US010309290B2

(12) United States Patent
Yamashita

(10) Patent No.: US 10,309,290 B2
(45) Date of Patent: Jun. 4, 2019

(54) PISTON COOLING DEVICE

(71) Applicant: TOYOTA JIDOSHA KABUSHIKI KAISHA, Toyota-shi, Aichi-ken (JP)

(72) Inventor: Akira Yamashita, Sunto-gun (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/480,666

(22) Filed: Apr. 6, 2017

(65) Prior Publication Data

US 2017/0350304 A1 Dec. 7, 2017

(30) Foreign Application Priority Data

Jun. 3, 2016 (JP) ..... 2016-111786

(51) Int. Cl.

| | |
|---|---|
| ***F01M 1/08*** | (2006.01) |
| ***F01P 3/08*** | (2006.01) |
| ***F01P 3/10*** | (2006.01) |
| ***F01P 5/10*** | (2006.01) |
| ***F01P 5/12*** | (2006.01) |
| ***F01P 7/14*** | (2006.01) |
| ***F02F 3/00*** | (2006.01) |
| ***F02F 3/22*** | (2006.01) |

(52) U.S. Cl.

CPC ..... *F01P 5/12* (2013.01); *F01M 1/08* (2013.01); *F01P 3/08* (2013.01); *F01P 3/10* (2013.01); *F01P 7/14* (2013.01); *F02F 3/0092* (2013.01); *F02F 3/22* (2013.01); *F01P 2005/105* (2013.01); *F01P 2005/125* (2013.01); *F01P 2007/146* (2013.01); *F05C 2251/048* (2013.01)

(58) Field of Classification Search

CPC ..... F01P 5/12; F01P 3/10; F01P 3/08; F01P 7/14; F01P 2007/146; F01P 2005/125; F02F 3/0092

See application file for complete search history.

(56) References Cited

U.S. PATENT DOCUMENTS

| | | | | |
|---|---|---|---|---|
| 2009/0020007 | A1* | 1/2009 | Lin | C21D 1/58 92/186 |
| 2010/0031917 | A1 | 2/2010 | Abe | |
| 2013/0164163 | A1* | 6/2013 | Ohnishi | F04C 2/344 418/27 |
| 2013/0206084 | A1* | 8/2013 | Azevedo | F01P 3/08 123/41.35 |
| 2017/0030292 | A1 | 2/2017 | Linke et al. | |

FOREIGN PATENT DOCUMENTS

| | | | | |
|---|---|---|---|---|
| FR | 2909410 A1 * | 6/2008 | | F01M 1/02 |
| GB | 2431217 A * | 4/2007 | | F01M 1/08 |
| JP | 2003-269163 A | 9/2003 | | |

(Continued)

*Primary Examiner* — Jacob M Amick
*Assistant Examiner* — Charles Brauch
(74) *Attorney, Agent, or Firm* — Finnegan, Henderson, Farabow, Garrett & Dunner, LLP

(57) ABSTRACT

A cooling cavity is provided inside a piston of an internal combustion engine. Inlet/outlet holes of the cooling cavity are provided in a bottom surface of the piston. A first oil jet that sprays oil toward the inlet/outlet hole, a second oil jet that sprays oil toward a part different from the inlet/outlet hole are included. The first oil jet is caused to spray oil in preference to the second oil jet.

18 Claims, 10 Drawing Sheets

(56) References Cited

FOREIGN PATENT DOCUMENTS

| | | | |
|---|---|---|---|
| JP | 2003-301744 | | 10/2003 |
| JP | 2004-324526 | A | 11/2004 |
| JP | 2006-138307 | A | 1/2006 |
| JP | 2008-163936 | | 7/2008 |
| JP | 2009-250178 | A | 10/2009 |
| JP | 2012-215138 | A | 11/2012 |
| JP | 2014-518979 | A | 8/2014 |
| WO | WO 2011-056822 | A2 | 5/2011 |
| WO | WO 2015/154877 | A1 | 10/2015 |

* cited by examiner

| | Aluminum | Iron |
|---|---|---|
| Specific Gravity [g/cc] | 2.7 | 7.87 |
| Thermal Capacity [J/(mol·K)] | 24.2 | 25.1 |
| Heat Conductivity [W/(m·K)] | 237 | 80.4 |
| Coefficient of Thermal Expansion [μm/(m·K)] | 23.1 | 11.8 |

PISTON COOLING DEVICE

BACKGROUND OF THE INVENTION

Field of the Invention

Embodiments of the present invention relates to a piston cooling device, and particularly relates to a piston cooling device for keeping a temperature of a piston disposed in a cylinder of an internal combustion engine, at an appropriate temperature.

Background Art

Patent Literature 1 discloses a cooling device for cooling a piston disposed in a cylinder of an internal combustion engine. The piston described in Patent Literature 1 includes a cooling cavity inside the piston. The cooling cavity communicates with two inlet/outlet holes provided at a bottom surface side of the piston.

At the bottom surface side of the piston, two oil jets are provided. One of the oil jets is provided to face one of the inlet/outlet holes when the piston is located in the vicinity of a top dead center. The other oil jet is provided to face the other inlet/outlet hole when the piston is located in the vicinity of the bottom dead center.

According to the above described configuration, a flow of oil can be made in the cooling cavity by supplying oil from the one of the inlet/outlet holes when the piston is located in the vicinity of the top dead center. Further, when the piston is located in the vicinity of the bottom dead center, a flow of the oil can be formed in the cooling cavity by supplying the oil from the other inlet/outlet hole. Consequently, according to the above described conventional cooling device, the piston can be properly cooled from the inside of the piston during an operation of the internal combustion engine.

LIST OF RELATED ART

Following is a list of patent literatures which the applicant has noticed as related arts of the present invention.

[Patent Literature 1]

Japanese Patent Laid-Open No. 2003-301744 A

[Patent Literature 2]

Japanese Patent Laid-Open No. 2008-163936 A

PROBLEM TO BE SOLVED BY EMBODIMENTS OF THE INVENTION

In an internal combustion engine, in addition to the oil jet as described above, a jet or the like for spraying oil toward the bottom surface of the piston may be used. When the jet that sprays oil toward the cooling cavity is used together with another oil jet, it is necessary to control the both the jets so as to spray just enough amount of oil in order to keep a proper temperature of the piston.

However, the cooling device described in Patent Literature 1 includes only the jets that supply oil to the cooling cavity of the piston, and does not provide a solution to the case where a jet of this kind and another oil jet having a different purpose are used in combination.

Embodiments of the present invention have been made to solve the problem as described above, and it is an object of the embodiments of the present invention to provide a piston cooling device that uses an oil jet for supplying oil to a cooling cavity of a piston and an oil jet having a different purpose in combination, and can properly keep a temperature of the piston stably for a long period of time.

SUMMARY

To achieve the above mentioned purpose, a first aspect of an embodiment of the present invention is a piston cooling device that is installed in an internal combustion engine. The piston cooling device comprises: a cooling cavity that is provided inside the piston, and includes an inlet/outlet hole that opens on a bottom surface of the piston; a first oil jet that sprays oil toward the inlet/outlet hole; and a second oil jet that sprays oil toward a part different from the inlet/outlet hole, wherein the first oil jet sprays oil in preference to the second oil jet.

A second aspect of an embodiment of the present invention is a piston cooling device according to the first aspect discussed above, wherein the piston cooling device further comprises an oil pump that generates an oil pressure that is necessary to spray oil, and wherein when a discharge oil amount of the oil pump is smaller as compared with an oil amount necessary to cause oil to be sprayed from both of the first oil jet and the second oil jet, the discharge oil amount is consumed preferentially in oil spray from the first oil jet.

A third aspect of an embodiment of the present invention is a piston cooling device according to the second aspect discussed above, wherein the first oil jet and the second oil jet communicate with the oil pump via a common oil pressure path, and a valve opening pressure of the first oil jet is a lower pressure as compared with a valve opening pressure of the second oil jet.

A fourth aspect of an embodiment of the present invention is a piston cooling device according to the third aspect discussed above; wherein the oil pump is a two stage type oil pump having a function of switching a generated oil pressure to two stages of a low pressure side and a high pressure side, the valve opening pressure of the first oil jet is equal to or lower than the generated oil pressure of the low pressure side, and the valve opening pressure of the second oil jet is higher than the generated oil pressure of the low pressure side, and is equal to or lower than a generated oil pressure of the high pressure side.

A fifth and sixth aspect of an embodiment of the present invention is a piston cooling device according to the third or fourth aspect discussed above; wherein the internal combustion engine comprises a plurality of cylinders, the first oil jet and the second oil jet are disposed in each of the cylinders, and the first oil jet and the second oil jet that belong to each of the plurality of cylinders communicate with the common oil pressure path.

A seventh aspect of an embodiment of the present invention is a piston cooling device according to the second aspect discussed above, wherein the first oil jet and the second oil jet communicate with the oil pump via a common oil pressure path. The piston cooing device further comprises: a control mechanism that controls an amount of oil that is sprayed from the second oil jet; and a control device that controls the control mechanism so that the amount of the oil that is sprayed from the second oil jet decreases, when an oil pressure that is supplied to the first oil jet is lower as compared with a pressure that is necessary to cause oil to be sprayed from the first oil jet.

A eighth aspect of an embodiment of the present invention is a piston cooling device according to the second aspect discussed above, wherein the piston cooling device further comprises: an oil pump that supplies an oil pressure to the first oil jet by being driven by drive torque of the internal combustion engine; an electric oil pump that is driven by electric power and supplies an oil pressure to the second oil jet; and a control device that causes oil that is supplied from the electric oil pump to be sprayed from the second oil jet under a condition in which oil spray by the second oil jet is required.

A ninth aspect of an embodiment of the present invention is a piston cooling device according to the first aspect discussed above, wherein an amount of oil that is sprayed from the second oil jet is preferentially decreased under an condition of excessive cooling ability in which excessive cooling occurs to the piston when oil is sprayed from both of the first oil jet and the second oil jet.

A tenth aspect of an embodiment of the present invention is a piston cooling device according to the ninth aspect discussed above, wherein the piston cooling device further comprises: a control mechanism that controls the amount of the oil that is sprayed from the second oil jet; and a control device that controls the control mechanism so that the amount of the oil that is sprayed from the second oil jet decreases under the condition of excessive cooling ability.

An eleventh aspect of an embodiment of the present invention is a piston cooling device according to the first aspect discussed above, wherein the piston is made of steel.

ADVANTAGES OF EMBODIMENTS OF THE PRESENT INVENTION

In the first aspect of an embodiment of the invention, the cooling cavity is provided inside the piston, and therefore easily receives a temperature from a piston top surface. Consequently, deposit is easily generated inside the cooling cavity. In the present invention, oil spray from the first oil jet is performed in preference to oil spray from the second oil jet, during an operation of the internal combustion engine. When oil is sprayed from the first oil jet, a flow of the oil is kept in the cooling cavity, and generation of deposit is suppressed. Consequently, according to the present invention, the cooling efficiency by the cooling cavity is hardly impaired, and the temperature of the piston can be properly kept stably for a long period of time.

According to the second aspect of an embodiment of the invention, oil can be preferentially sprayed from the first oil jet, when oil cannot be sprayed from both of the oil jets due to a constraint of the discharge oil amount of the oil pump.

According to the third aspect of an embodiment of the invention, in the process of the pressure of the oil pressure path increasing, oil spray from the first oil jet is started first. Consequently, according to the present invention, under the situation where the discharge oil amount of the oil pump is insufficient to cause oil to be sprayed from both of the oil jets, the discharge oil amount can be consumed preferentially in oil spray from the first oil jet.

According to the fourth aspect of an embodiment of the invention, when the generated oil pressure of the oil pump is at the low pressure side, oil is sprayed from the first oil jet, whereas oil is not sprayed from the second oil jet. Further, when the generated oil pressure of the oil pump is at the high pressure side, oil is sprayed from both of the oil jets. Consequently, according to the present invention, by switching the state of the oil pump, a state with priority given to the first oil jet, and a state of spray from both of the oil jets can be switched reliably.

According to the fifth or sixth aspect of an embodiment of the invention, the generated oil pressure of the oil pump is supplied to the first oil jet and the second oil jet that are disposed in each of the plurality of cylinders in common. When the valve opening pressure of the first oil jet and the valve opening pressure of the second oil jet are the same in this case, such a variation occurs that valves of both of the oil jets open in some of the cylinders, whereas none of valves of the oil jets opens in other cylinders, under the situation where the generated oil pressure is close to the valve opening pressure. In the present invention, the valves of the second oil jets do not open in all of the cylinders, unless the valves of the first oil jets open in all of the cylinders, due to the difference of the valve opening pressures. Consequently, according to the present invention, variations among the cylinders concerning piston cooling can be suppressed.

According to the seventh aspect of an embodiment of the invention, when the oil pressure that is supplied to the first oil jet is insufficient, the amount of oil that is sprayed from the second oil jet is decreased. Since the first oil jet and the second oil jet communicate with the oil pump via the common oil pressure path, if the amount of oil that is sprayed from the second oil jet decreases, the oil pressure that is supplied to the first oil jet increases. Consequently, according to the present invention, under the environment of an insufficient oil pressure, the first oil jet can be preferentially caused to spray oil.

According to the eighth aspect of an embodiment of the invention, the oil pressure is supplied from the mechanical type of electric pump to the first oil jet. Since the oil pressure is supplied to the second oil jet from the electric pump, the oil pressure that is generated by the mechanical type electric pump is not consumed in the second oil jet, but is supplied to the first oil jet. Consequently, according to the present invention, even at the low load time in which the ability of the oil pump is low, a sufficient oil amount can be provided to the first oil jet, and oil can be preferentially sprayed from the first oil jet.

According to the ninth aspect of an embodiment of the invention, under the condition of excessive cooling ability, the oil amount from the second oil jet is preferentially decreased. As a result, the situation where the first oil jet sprays oil in preference to the second oil jet is created. According to the situation, accumulation of deposit in the cooling cavity can be effectively inhibited while avoiding excessive cooling of the piston.

According to the tenth aspect of an embodiment of the invention, by using the control mechanism that controls the oil amount from the second oil jet, and the control device that controls the control mechanism, the state that does not cause excessive cooling and does not accumulate deposit in the cooling cavity can be effectively created under establishment of the condition of excessive cooling ability.

According to the eleventh aspect of an embodiment of the invention, the steel piston can be properly cooled. The steel piston easily has a high temperature as compared with an aluminum piston, and deposit is easily generated in the cooling cavity. According to the present invention, oil can be preferentially supplied into the cooling cavity, and therefore even if the piston is made of steel, accumulation of deposit can be effectively prevented.

DESCRIPTION OF REFERENCE NUMERALS

Figure 1:
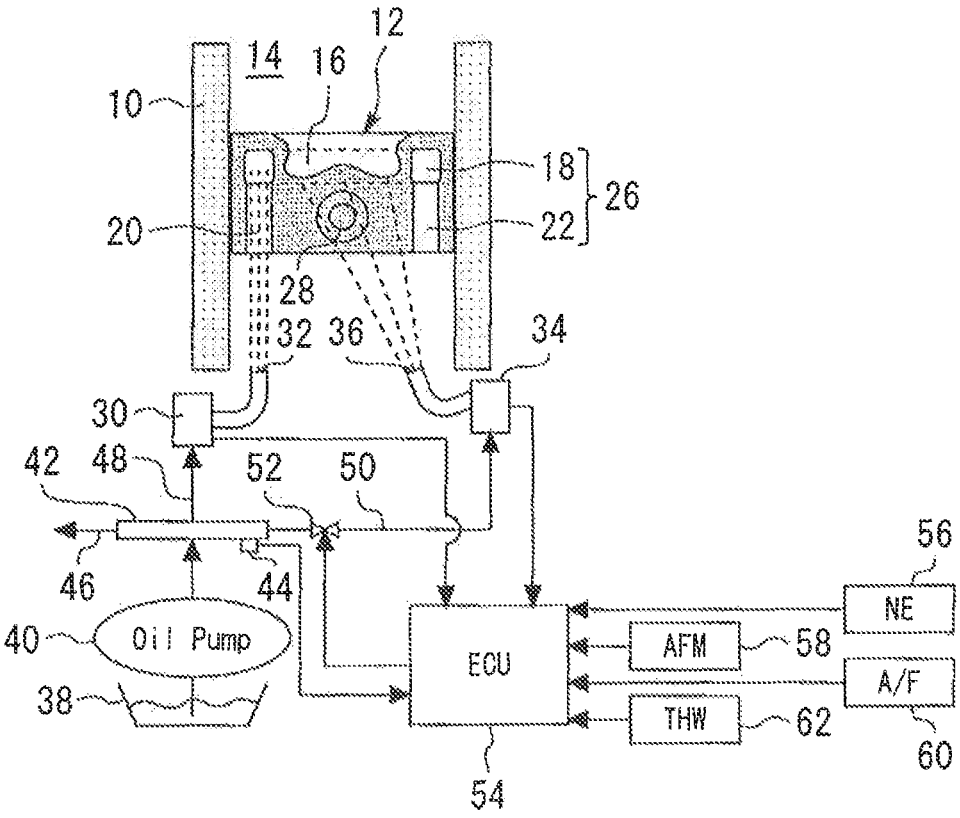
FIG. 1 is a diagram showing the configuration of a first embodiment of the present invention.

12 Piston
18 Ring-shaped cavity
20, 22 Inlet/outlet holes
26 Cooling cavity
30 First oil jet
34, 72 Second oil jet
40 Oil Jet
42 Main gallery
54 Electronic controlled unit (ECU)
70 Electric oil pump

DETAILED DESCRIPTION

First Embodiment

[Configuration of First Embodiment]

FIG. 1 is a diagram for explaining a configuration of a piston cooling device according to a first embodiment of the present invention. FIG. 1 illustrates a cylinder liner 10 disposed in one cylinder of an internal combustion engine, and a piston 12 disposed therein. Although the internal combustion engine has a plurality of cylinders, FIG. 1 illustrates only one the cylinders for convenience.

On a top surface of the piston 12, a cavity 16 that opens to a combustion chamber 14 is provided. In the piston 12, a ring-shaped cavity 18 is formed to surround the cavity 16. The ring-shaped cavity 18 is provided inside the piston 12. Inside the piston 12, two inlet/outlet holes 20 and 22 that are disposed to face each other in a diameter direction of the piston 12 are further provided. The inlet/outlet holes 20 and 22 open to a bottom surface of the piston 12, extend in an axial direction of the piston 12 to communicate with the ring-shaped cavity 18. Hereinafter, the ring-shaped cavity 18 and the inlet/outlet holes 20 and 22 are generically called "a cooling cavity" 26.

The piston 12 includes a pin boss 28 on a bottom surface side. A connecting rod that connects to a crankshaft (both are not illustrated) is connected to the pin boss 28. A first oil jet 30 is disposed at the bottom surface side, that is, at a crankcase side of the piston 12. The first oil jet 30 contains a check valve that opens at a certain valve opening pressure. When the first oil jet 30 receives supply of an oil pressure that exceeds the valve opening pressure, the first oil jet 30 sprays oil from an injection hole 32 thereof. The injection hole 32 is provided so that the axis of oil sprayed from the injection hole 32 becomes parallel with a direction of a reciprocating motion of the piston 12, and heads for an opening portion of the one inlet/outlet hole 20. Consequently, the oil that is sprayed from the first oil jet 30 is sprayed toward the opening portion of the inlet/outlet hole 20 in a substantially entire process of the reciprocating motion of the piston 12.

On the bottom surface side of the piston 12, a second oil jet 34 is also disposed. The second oil jet 34 has a function of spraying oil by receiving supply of an oil pressure that exceeds a certain valve opening pressure similarly to the first oil jet 30. In the present embodiment, the valve opening pressure of the first oil jet 30 and the valve opening pressure of the second oil jet 34 are the same. An injection hole 36 of the second oil jet 34 is provided to spray oil toward the bottom surface of the piston 12, more specifically, toward a periphery of the pin boss 28, instead of the opening portions of the inlet/outlet holes 20 and 22.

A configuration illustrated in FIG. 1 includes an oil pressure circuit for supplying oil to the first oil jet 30 and the second oil jet 34. The oil pressure circuit includes an oil pump 40 that pumps up oil from an oil pan 38 of the internal combustion engine. The oil pump 40 is a mechanical type pump that is driven by drive torque of the internal combustion engine.

The outlet port of the oil pump 40 communicates with a main gallery 42. To the main gallery 42, an oil pressure sensor 44 for detecting an oil pressure inside the main gallery 42 is attached. Further, an oil passage 46 for supplying oil to respective parts of the internal combustion engine, an oil passage 48 that leads to the first oil jet 30, and an oil passage 50 that leads to the second oil jet 34 communicate with the main gallery 42.

An oil control valve 52 is incorporated into the oil passage 50 that leads to the second oil jet 34. The oil control valve 52 is an electronically controlled valve mechanism that changes an opening degree by receiving an instruction from an outside. According to the oil control valve 52, an amount of oil that flows to the second oil jet 34 from the main gallery 42 can be controlled.

An electronic controlled unit (ECU) 54 is connected to the oil control valve 52. The oil pressure sensor 44 is connected to the ECU 54. Further, various sensors that the internal combustion engine is equipped with are connected to the ECU 54. More specifically, sensors as follows are connected to the ECU 54:

- an engine rotation speed sensor 56 that detects an engine rotation speed;
- an air flow meter 58 that detects an intake air amount;
- an air-fuel ratio sensor 60 that detects an exhaust air-fuel ratio;
- a water temperature sensor 62 that detects a cooling water temperature;
- an oil amount sensor incorporated in the first oil jet 30; and
- an oil amount sensor incorporated in the second oil jet 34.

Figures 2, 3:
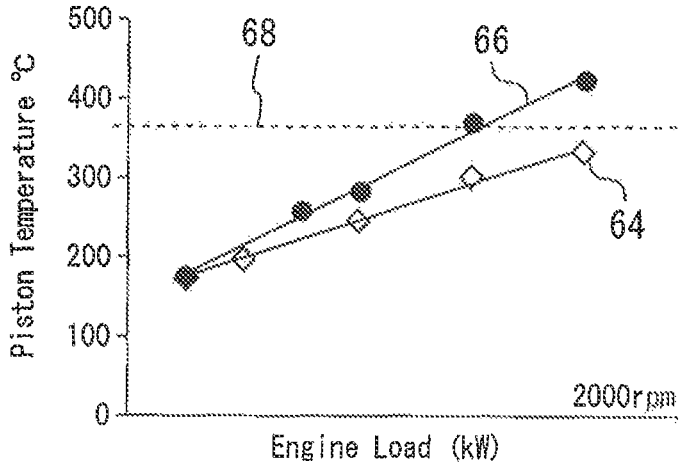
FIG. 2 is a diagram showing properties of aluminum and iron in a comparative manner.
FIG. 3 is a diagram showing a temperature of an aluminum piston and a temperature of a steel piston in a comparative manner.

In the present embodiment, the piston 12 of the internal combustion engine is made of steel. FIG. 2 is a diagram showing properties of aluminum and iron in a comparative manner. Further, FIG. 3 is a diagram showing a temperature track of an aluminum piston and a temperature track of a steel piston in a comparative manner. Note that the temperatures belong to the tracks 64 and 66 illustrated in FIG. 3 are ones that are obtained when a load of the internal combustion engine is changed under a fixed engine rotation speed.

As illustrated in FIG. 2, a heat conductivity of iron is much lower as compared with the heat conductivity of aluminum. Consequently, as illustrated in FIG. 3, the temperature 66 of the steel piston easily becomes higher as compared with the temperature 64 of the aluminum piston. Here, a broken line shown by being assigned with reference numeral 68 in FIG. 3 represents a temperature at which carbonization of oil starts. As illustrated in FIG. 3, in the steel piston, the temperature 66 thereof more easily reaches the carbonization start temperature 68 as compared with the aluminum piston. Consequently, in the internal combustion engine using the steel piston 12 as in the present embodiment, it is especially important to cool the piston 12 properly so that carbonization of oil does not occur.

[Operation of Piston Cooling Device of First Embodiment]

During an operation of the internal combustion engine, large combustion heat is generated inside the combustion chamber 14. The top surface of the piston 12 is exposed to the combustion heat and has a high temperature. The ring-shaped cavity 18 is provided at a position close to the top surface of the piston 12. Consequently, an inside of the ring-shaped cavity 18 more easily has a high temperature as compared with the bottom surface of the piston 12. On the other hand, cooling the ring-shaped cavity 18 properly with oil can reduce the top surface temperature of the piston 12 more efficiently than cooling the bottom surface of the piston 12 with oil.

(Condition of Normal Operation)

The piston cooling device of the present embodiment sprays oil toward the piston 12 from both the first oil jet 30 and the second oil jet 34 under the condition of normal operation. The oil that is sprayed from the first oil jet 30 enters into the cooling cavity 26 from the inlet/outlet hole 20, and flows in the ring-shaped cavity 18 to flow out from the inlet/outlet hole 22. On the other hand, the oil that is sprayed from the second oil jet 34 is sprayed to the bottom surface of the piston 12, in particular, the periphery of the pin boss. According to this manner, oil can be continued to flow in the cooling cavity 26, and the piston 12 can be also cooled from the bottom surface. As a result, overheating of the piston 12 can be properly prevented.

(Condition of Excessive Cooling Ability)

The amount of heat received by the piston 12 from the combustion chamber 14 varies in accordance with a load state of the internal combustion engine. For example, in a low load state of an idle operation or the like, the heat amount is inevitably small. When oil is sprayed from both of the first oil jet 30 and the second oil jet 34 under the situation like this, the piston 12 may be excessively cooled. Hereinafter, a condition under which excessive cooling like this occurs will be referred to as "a condition of excessive cooling ability".

Under the condition of excessive cooling ability, stopping oil cooling of the piston 12 is conceivable, for example, in order to avoid excessive cooling of the piston 12. However, the inside of the ring-shaped cavity 18 is close to the top surface of the piston 12, and easily has a high temperature even under the condition like this. If oil cooling of the piston 12 is stopped under the cooling ability excess condition, the temperature in the ring-shaped cavity 18 may reach the carbonization start temperature 68 (refer to FIG. 3).

Consequently, under the condition of excessive cooling ability, the present embodiment closes the oil control valve 52 so as to stop only oil spraying from the second oil jet 34. According to the procedure, the cooling ability to the entire piston 12 is reduced as compared with the cooling ability under the condition of normal operation. As a result, excessive cooling of the piston 12 can be properly avoided. Further, since spraying from the first oil jet 30 is continued, oil continues to flow in the cooling cavity 26. As a result, the temperature in the ring-shaped cavity 18 is lowered, generation of deposit by carbonization of oil is avoided, and even if carbonization of oil occurs, carbide of the oil can be washed away, so that accumulation of deposit can be prevented.

(Condition of Insufficient Oil Pressure)

In the present embodiment, a generated oil pressure of the oil pump 40 varies in accordance with the state of the internal combustion engine. For example, when the internal combustion engine is in a low load state of an idle operation or the like, the generated oil pressure becomes relatively low. On the other hand, when the internal combustion engine is in a high load state of an acceleration operation or the like, the oil pressure becomes high. Further, the generated oil pressure of the oil pump 40 is also influenced by viscosity of the oil. Consequently, under a situation where the oil temperature is high and the oil viscosity is low, the generated oil pressure of the oil pump 40 becomes relatively low.

As illustrated in FIG. 1, in the piston cooling device of the present embodiment, the first oil jet 30 and the second oil jet 34 both receive supply of the oil pressure from the oil pump 40 via the main gallery 42. Consequently, under a low load state or a high oil temperature state where the generated oil pressure of the oil pump 40 is low, there arises a situation where oil cannot be sprayed from both the first oil jet 30 and the second oil jet 34.

Under such a situation, practically, the valve of either the first or the second oil jet opens so as to start oil spray just from the jet, at a time point at which the oil pressure of the main gallery 42 reaches the valve opening pressure of the first oil jet 30 and the second oil jet 34. When either one of the jets starts spraying oil, the oil pressure of the main gallery 42 is reduced, and the other jet is brought into a state where its valve is not able to open. In a case where the second oil jet 34 starts spraying oil precedently, oil is not sprayed from the first oil jet 30 thereafter. Hereinafter, such a condition in which the discharge oil amount from the oil pump 40 is insufficient for making both of the oil jets spray oil will be referred to as "a condition of insufficient oil pressure".

In the present embodiment, under the condition of insufficient oil pressure, the oil control valve 52 is closed to cut off oil pressure supply to the second oil jet 34. When the oil pressure supply to the second oil jet 34 is cut off, oil spray from the first oil jet 30 is reliably started at the time point at which the oil pressure of the main gallery 42 reaches the valve opening pressure.

As described above, oil cooling by the cooling cavity 26 can cool the piston 12 more efficiently as compared with oil cooling of the bottom surface of the piston 12. Further, the inside of the cooling cavity 26, in particular, the inside of the ring-shaped cavity 18 more easily has a high temperature as compared with the bottom surface of the piston 12, and is in an environment where deposit is readily generated. Consequently, under the environment where oil can be sprayed from only either one of the jets, priority is desirably given to spray from the first oil jet 30. According to the piston cooling device of the present embodiment, the request can be satisfied under the condition of insufficient oil pressure.

(Control Flow in the First Embodiment)

Figure 4:
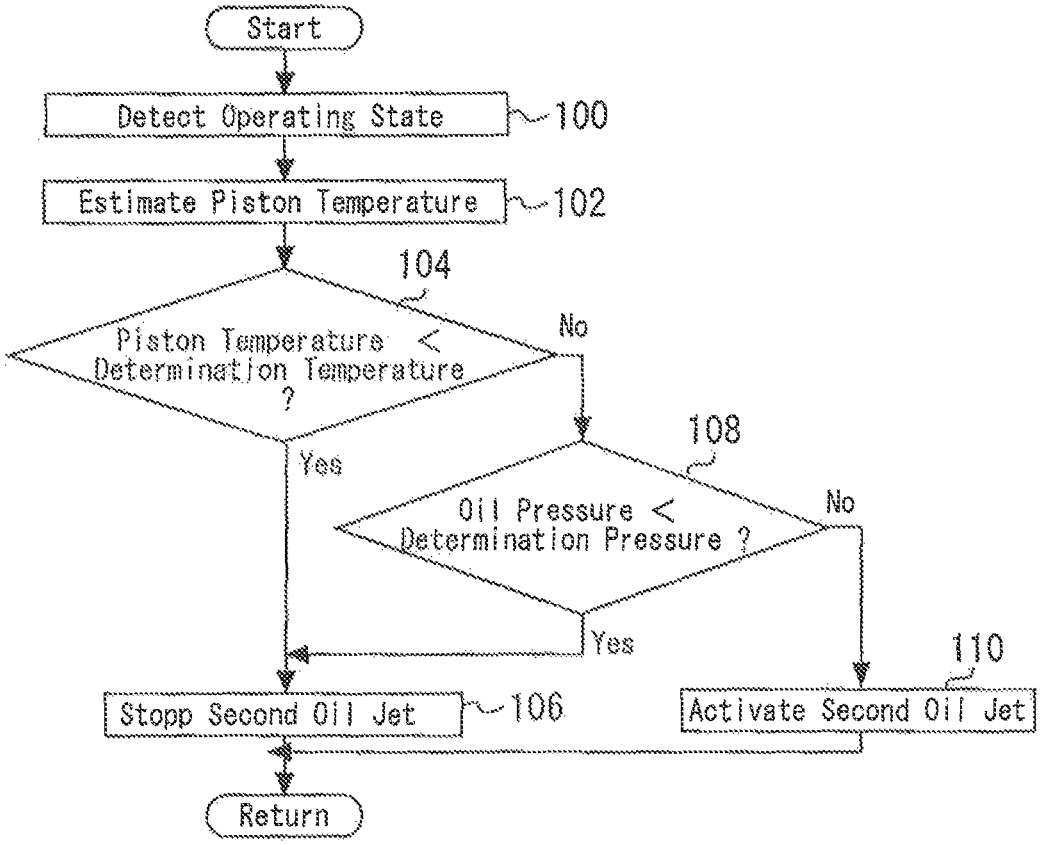
FIG. 4 is a flowchart of a routine executed in the first embodiment of the present invention.

FIG. 4 is a flowchart of a routine executed by the ECU 54 in the first embodiment of the present invention. The routine illustrated in FIG. 4 is repeatedly started up at predetermined periods after start-up of the internal combustion engine. In the routine, an operating state of the internal combustion engine is detected first (step 100). More specifically, in the present step, information necessary for estimation of the temperature of the piston 12 and detection of the oil temperature is detected from various sensors which are installed in the internal combustion engine.

Next, a temperature of the piston 12 is estimated (step 102). The temperature of the piston 12 can be calculated based on a heat input amount Qin to the piston 12 and a heat release amount Qout from the piston 12. Further, the heat input amount Qin can be calculated by a known method based on the engine rotation speed, the fuel injection amount, the amount of gas flowing in the combustion chamber 14 and the like. On the other hand, the heat release amount Qout can be calculated by a known method based on an amount of oil sprayed toward the piston 12 and an oil temperature or the like. The temperature of the piston 12 may be estimated in accordance with a map that is set in advance with the engine rotation speed, the intake air amount and the like as parameters.

Next, it is determined whether or not the temperature of the piston 12 is lower than a determination temperature of the condition of excessive cooling ability (step 104). Processing of the present step is executed to determine whether or not the condition of excessive cooling ability is established. Note that whether or not the condition of excessive cooling ability is established may be determined based on the engine rotation speed, the engine load, the cooling water temperature, the intake air temperature and the like.

When it is determined that the temperature of the piston 12 is lower than the determination temperature in step 104 described above, it can be determined that the condition of excessive cooling ability is established. That is, in this case, it can be determined that the piston 12 reaches the state of being excessively cooled if oil is continued to be sprayed from both the first oil jet 30 and the second oil jet 34. In this case, the oil control valve 52 is closed so that oil spray from the second oil jet 34 is stopped (step 106).

When it is determined that the temperature of the piston 12 is not lower than the determination temperature in the processing of step 104 described above, it can be determined that the condition of excessive cooling ability is not established. In this case, it is determined whether or not the pressure of the main gallery 42 is lower than a determination pressure of the condition of insufficient oil pressure (step 108). Processing of the present step is executed to determine whether the condition of insufficient oil pressure is established or not. It should be noted that the determination about the condition of insufficient oil pressure may be performed based on a discharge oil amount (capacity) of the oil pump 40.

When it is determined that the oil pressure of the main gallery 42 is lower than the determination oil pressure in step 108 described above, it can be determined that the condition of insufficient oil pressure is established. That is, in this case, it can be determined that the discharge oil amount of the oil pump 40 is insufficient to spray oil from both of the first oil jet 30 and the second oil jet 34. In this case, in order to give priority to oil spray from the first oil jet 30, the processing in step 106 described above is executed.

When it is determined that the oil pressure of the main gallery 42 is not lower than the determination oil pressure in step 108 described above, it can be determined that the condition of excessive cooling ability and the condition of insufficient oil pressure are not established. In this case, the oil control valve 52 is opened to cause oil to be sprayed from the second oil jet 34 in addition to the first oil jet 30 (step 110).

According to the above processing, oil can be sprayed from the first oil jet 30 in preference to oil spray from the second oil jet 34 under the condition of excessive cooling ability as well as under the condition of insufficient oil pressure. Consequently, according to the piston cooling device of the present embodiment, the piston 12 can be kept at a proper temperature even under those conditions, and generation or accumulation of deposit in the cooling cavity 26 can be effectively inhibited. Therefore, according to the device, the ability to cool the piston to a proper temperature stably can be kept over a long period of time.

[Modification Example of First Embodiment]

In the above described first embodiment, the steel piston 12 is used, but the material of the piston 12 is not limited to iron. That is, the present invention may be applied to pistons that are formed from materials other than iron, such as a piston of aluminum.

In the above described first embodiment, the second oil jet 34 which sprays oil to a part different from the inlet/outlet holes 20 and 22 of the cooling cavity 26 sprays oil to the bottom surface of the piston 12. The present invention is not limited to this. That is, for example, the second oil jet 34 may inject oil toward the part other than the piston 12. Further, the number of jets that spray oil to the parts different from the inlet/outlet holes 20 and 22 is not limited to one, but may be two or more.

In the first embodiment described above, spray from the second oil jet 34 is stopped when priority should be given to oil spray from the first oil jet 30. However, the present invention is not limited to this. For example, when priority is given to injection from the first oil jet 30 under the condition of excessive cooling ability, the oil spray amount from the second oil jet 34 may be decreased to an amount with which excessive cooling of the piston 12 does not occur. Further, when priority is given to injection from the first oil jet 30 under the condition of insufficient oil pressure, the spray amount from the second oil jet 34 may be decreased so that the oil amount that is supplied to the first oil jet 30 becomes a sufficient amount.

In the above described first embodiment, the first oil jet 30 always sprays oil during an operation of the internal combustion engine. The present invention is not limited to this. At a cold time in which cooling of the piston 12 is not required at all or the like, spray from the first oil jet 30 can be also stopped as well as spray from the second oil jet 34.

It should be noted that the main gallery 42 in the above described first embodiment corresponds to "a common oil pressure path" in the above described third aspect of the invention. Further, the oil control valve 52 and the ECU 54 correspond to "a control mechanism" and "a control device" in the above described seventh or tenth aspect of the invention.

Second Embodiment

Figure 5:
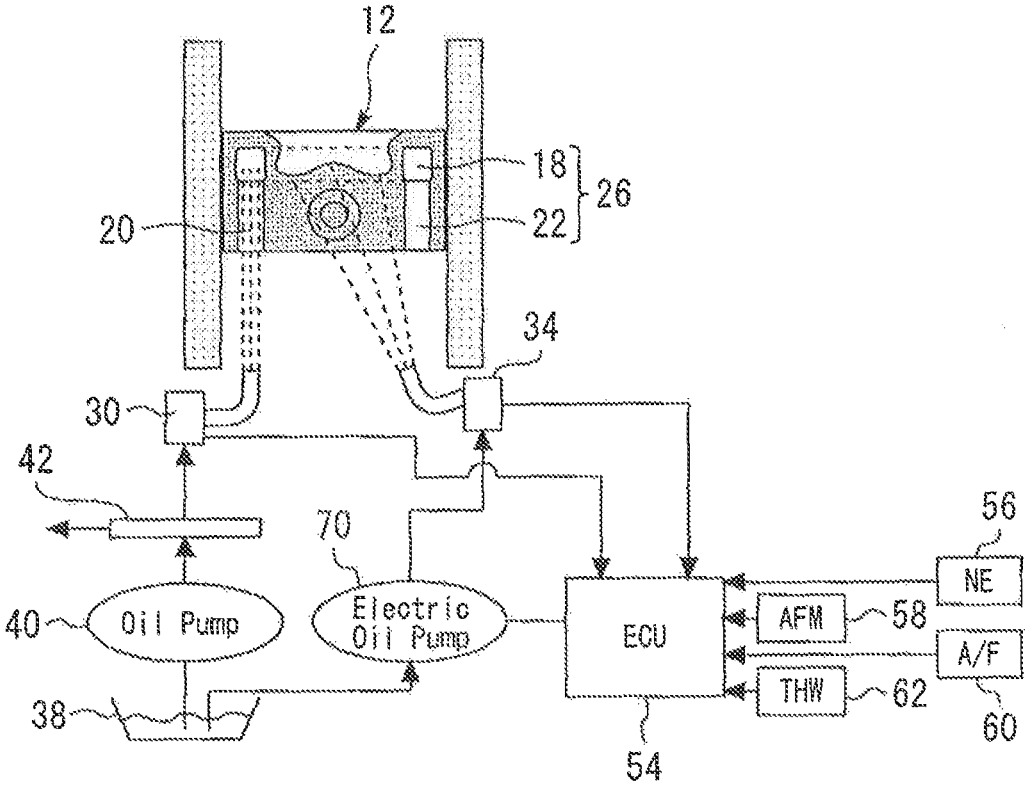
FIG. 5 is a diagram showing the configuration of a second embodiment of the present invention.

Next, a second embodiment of the present invention will be described with reference to FIGS. 5 and 6. FIG. 5 is a diagram for explaining a configuration of a piston cooling device of the second embodiment of the present invention. A configuration illustrated in FIG. 5 is similar to the configuration illustrated in FIG. 1, except for a point that the second oil jet 34 receives supply of an oil pressure from an electric oil pump 70 instead of the main gallery 42. Hereinafter, elements in FIG. 5 that are the same as or correspond to the elements illustrated in FIG. 1 will be assigned with common reference numerals, and explanation thereof will be omitted or simplified.

According to the configuration of the present embodiment, oil spray from the second oil jet 34 does not influence the oil pressure of the main gallery 42. Consequently, unlike the case of the first embodiment, the condition of insufficient oil pressure is not established in the present embodiment.

That is, in the piston cooling device of the present embodiment, a state where a generated oil pressure of the oil pump 40 is preferentially given to the first oil jet 30 is structurally ensured. Thus, according to the device, even in a condition in which an oil temperature is high and an oil viscosity is low, oil can be properly sprayed from the first oil jet 30.

Further, according to the configuration of the present embodiment, even under the situation where the condition of insufficient oil pressure is established in the first embodiment, oil can be sprayed from both of the first oil jet 30 and the second oil jet 34 by operating the electric oil pump 70. Consequently, according to the device of the present embodiment, a cooling ability that is more excellent as compared with the device of the first embodiment can be exhibited, under the situation like this.

Figure 6:
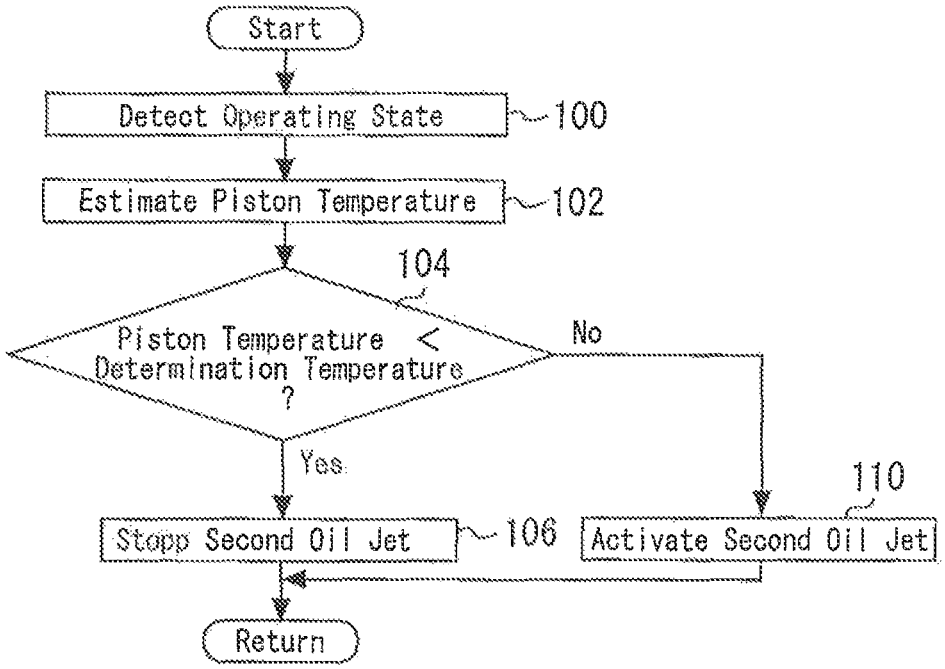
FIG. 6 is a flowchart of a routine executed in the second embodiment of the present invention.

FIG. 6 is a flowchart of a routine executed by the ECU 54 in the present embodiment. The flowchart illustrated in FIG. 6 is similar to the routine illustrated in FIG. 4 except for a point that step 108 is omitted. When stop of the second oil jet 34 is instructed in step 106 in the present embodiment, a stop instruction is issued to the electric oil pump 70. When the electric oil pump 70 is stopped, oil spray from the second oil jet 34 is also stopped. Consequently, according to the device of the present embodiment, excessive cooling can be properly prevented from occurring to the piston 12 while oil is caused to flow in the cooling cavity 26, under the condition of excessive cooling ability.

When oil spray from the second oil jet 34 is instructed in step 110 in the routine illustrated in FIG. 6, an operation instruction is issued to the electric oil pump 70. The electric oil pump 70 can generate an oil pressure exceeding the valve opening pressure of the second oil jet 34. Consequently, when the oil pump 70 is operated, the second oil jet 34 sprays oil toward the bottom surface of the piston 12. Thus, according to the device of the present embodiment, the piston 12 can be properly cooled by using both of the first oil jet 30 and the second oil jet 34 under the condition of normal operation.

As described above, the piston cooling device of the present embodiment can cause the oil to flow in the cooling cavity 26 similarly to the case of the first embodiment. Further, according to the device, the piston 12 can be cooled more properly than in the case of the first embodiment. Consequently, by the device of the present embodiment, the temperature of the piston 12 can be also properly kept stably for a long period of time.

[Modification Example of Second Embodiment]

Note that in the present embodiment, the piston 12 may be made of aluminum similarly to the case of the first embodiment. Further, the second oil jet 34 may spray oil toward a part other than the piston 12. Further, the number of second oil jets 34 may be two or more. Further, under the condition of excessive cooling ability, the oil spray amount from the second oil jet 34 may be decreased. Subsequently, oil from the first oil jet 30 may be stopped in accordance with necessity.

Note that in the above descried second embodiment, the ECU 54 corresponds to a "control device" in the above described seventh aspect of the invention. Further, the electric oil pump 70 and the ECU 54 correspond to a "control mechanism" and a "control device" in the above described tenth aspect of the invention.

Third Embodiment

Figure 7:
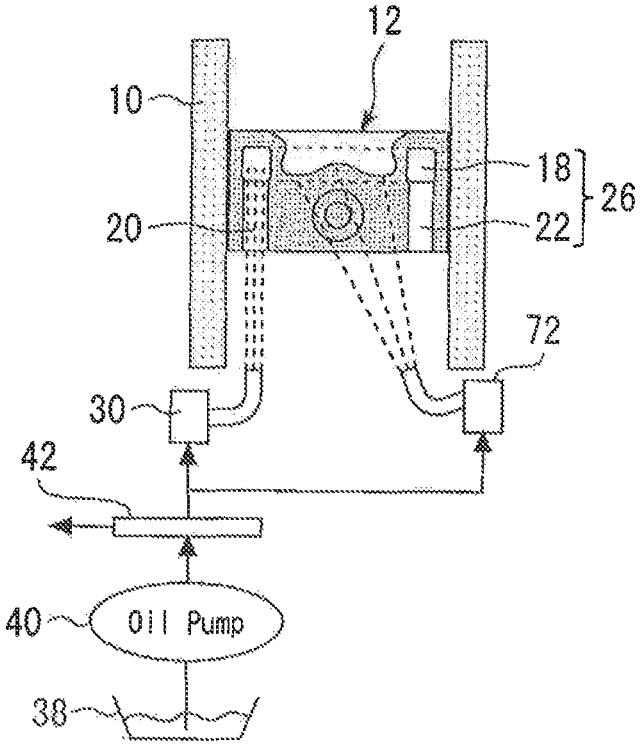
FIG. 7 is a diagram showing the configuration of a third embodiment of the present invention.

Next, with reference to FIGS. 7 to 10, the third embodiment of the present invention will be described. FIG. 7 is a diagram for explaining a configuration of a pump cooling device of the third embodiment. Hereinafter, in FIG. 7, elements that are the same as or correspond to the elements illustrated in FIG. 1 will be assigned with the common reference numerals and explanation thereof will be omitted or simplified.

The piston cooling device of the present embodiment includes a second oil jet 72. The second oil jet 72 directly communicates with the main gallery 42 without passing through the oil control valve 52 (refer to FIG. 1). The second oil jet 72 is given a valve opening pressure P2 that is higher than a valve opening pressure P1 of the first oil jet 30. The piston cooling device of the present embodiment does not require an electronic control unit, unlike the case of the first or the second embodiment.

[Operation of Third Embodiment]

(Operation in Single Cylinder)

Figure 8:
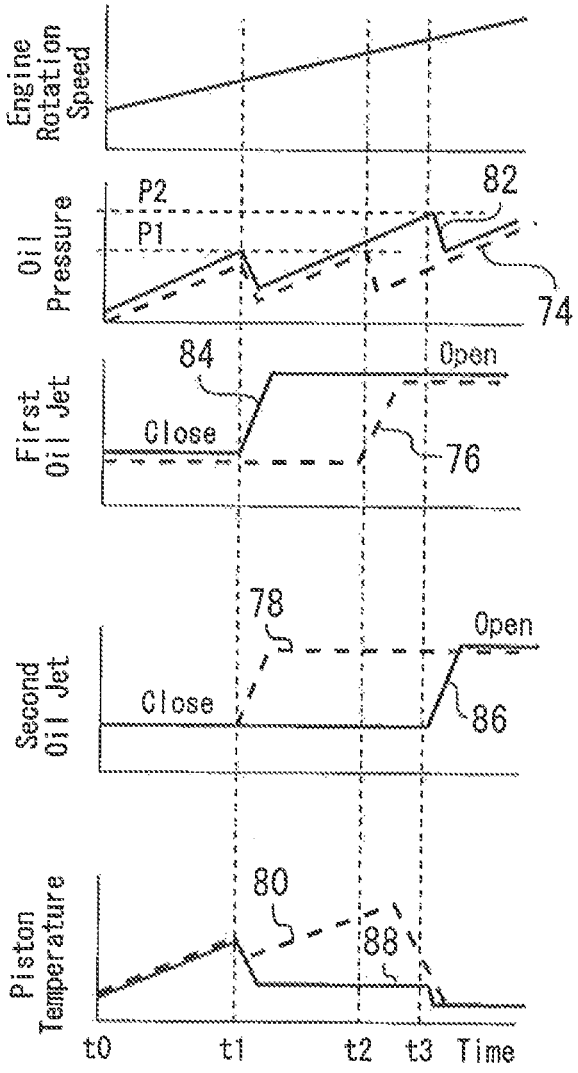
FIG. 8 is a timing chart for explaining an operation of the third embodiment of the present invention.

FIG. 8 is a timing chart for explaining an operation of the piston cooling device illustrated in FIG. 7 and an operation of a device of a comparative example in a comparative manner. Here, "the device of the comparative example" refers to a device in which the second oil jet 72 is replaced with the second oil jet 34 in the configuration illustrated in FIG. 7. A valve opening pressure of the second oil jet 34 used in the comparative example is set at P1 as in the case of the first oil jet 30.

The uppermost chart in FIG. 8 illustrates an engine rotation speed which increases at a fixed rate after a time point t0. Since the oil pump 40 is a mechanical type pump, a discharge oil amount from the oil pump 40 increases as the engine rotation speed increases.

In the second through the lowermost charts in FIG. 8, waveforms 74, 76, 78 and 80 illustrated by broken lines commonly express an operation of the device of the comparative example. On the other hand, waveforms 82, 84, 86 and 88 that are illustrated by solid lines in these charts commonly express the operation of the device of the present embodiment.

The second chart in FIG. 8 illustrates a change of the oil pressure in the main gallery 42. A third chart illustrates a valve opening state of the first oil jet 30. Further, a fourth chart illustrates a valve opening state of the second oil jet 72 or 34.

The waveform 74 illustrated in the second chart in FIG. 8 expresses that the oil pressure in the comparative example reaches the valve opening pressure P1 at a time point t1, then temporarily reduces, and thereafter reaches the valve opening pressure P1 again at a time point t2. In the comparative example, the valve opening pressure of the first oil jet 30 and the valve opening pressure of the second oil jet 34 are both P1. Accordingly, as the waveform 78 in the fourth chart illustrates, the valve of the second oil jet 34 may open at the time point t1 in the device of the comparative example.

When the valve of the second oil jet 34 opens, the oil pressure of the main gallery 42 temporarily drops to be a value which is lower than the valve opening pressure P1 at the time point (see, the waveform 74). At this time, the valve of the first oil jet 30 cannot open and keeps a closed state. When the oil pressure reaches to the valve opening pressure P1 again in the time point t2, the first oil jet 30 shifts to the valve opening state at this point of the time (see, the waveform 76 in the third chart).

The lowermost chart in FIG. 8 illustrates a temperature change of the piston 12. When the valve of the second oil jet 34 opens at the time point t1, and the valve of the first oil jet 30 opens at the time point t2, the temperature of the piston 12 shows a change along the waveform 80. Cooling efficiency by the second oil jet 34 is not as high as cooling efficiency by the first oil jet 30. Thus, in the case of the comparative example, after the time point t1, the temperature of the piston 12 temporarily lowers slightly, but thereafter increases again. Subsequently, after oil cooling of the cooling cavity 26 is started at the time point t2, the temperature increases continuously until the influence of the oil cooing is exerted onto the piston top surface. Accordingly, as shown by the waveform 80, the temperature of the piston 12 in the comparative example easily becomes a high temperature until the temperature converges to a stable value.

In the device of the present embodiment, the valve opening pressure of the second oil jet 72 is set at P2 that is higher than P1. Consequently, in the device, the valve of the second oil jet 72 does not open at the time point t1 (see, the waveform 86 in the fourth chart), and the valve of the first oil jet 30 reliably opens at the time point (see, the waveform 84 in the third chart).

The waveform 82 in the second chart shows that the oil pressure in the present embodiment temporarily drops at the time point t1, and thereafter reaches the valve opening pressure P2 at a time point t3. Further, the waveform 86 in the fourth chart illustrates that the valve of the second oil jet 72 in the present embodiment shifts to a valve opening state at the time point t3 receiving upon the oil pressure increase.

As described above, in the present embodiment, oil spray by the first oil jet 30 is reliably started at the time point t1. In this case, the temperature of the piston 12 drops greatly at the time point t1, and thereafter, keeps a substantially stable value, as illustrated by the waveform 88 in the lowermost chart. Subsequently, when spray from the second oil jet 72 is started at the time point t3, the temperature of the piston 12 further drops to converge to a stable value.

As described above, the piston cooling device of the present embodiment cam make the first oil jet 30 spray oil in preference to the second oil jet 72 under the environment where the oil pressure is low. The condition of excessive cooling ability is apt to be established when the internal combustion engine operates with a light load. During the light load operation of the internal combustion engine, the discharge oil amount of the oil pump 40 is small, and the generated oil pressure often becomes a low pressure. The device of the present embodiment causes only the first oil jet 30 to spray oil preferentially under the environment like this. Consequently, according to the device, the piston 12 can be kept at a proper temperature without generating deposit in the cooling cavity 26 under the environment where the condition of excessive cooling ability is established.

Further, according to the device of the present embodiment, under the condition of insufficient oil pressure, oil spray from the second oil jet 72 is inevitably stopped, and the situation where only the first oil jet 30 sprays oil is created. Consequently, according to the device, the piston 12 can be kept at a proper temperature without generating deposit in the cooling cavity 26, even under the condition of insufficient oil pressure.

(Operation in a Plurality of Cylinders)

The configuration illustrated in FIG. 7 is provided in each of a plurality of cylinders included by the internal combustion engine. The first oil jets 30 and the second oil jets 72 of the respective cylinders all communicate with the main gallery 42.

Figure 9:
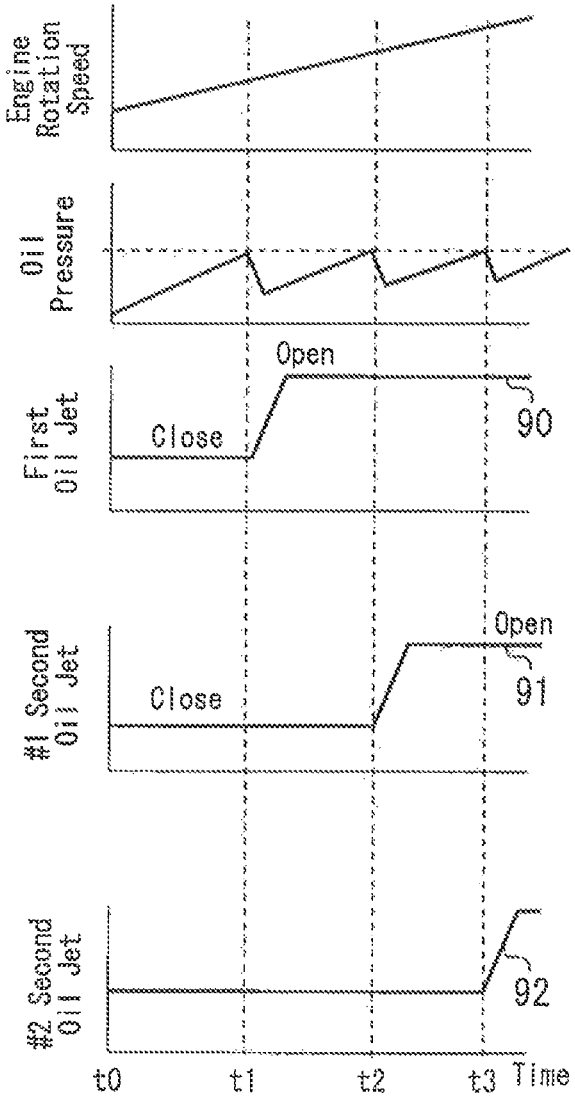
FIG. 9 is a timing chart for explaining an ununiformity arising between cylinders under a situation in which the opening pressure of two oil jets are identical.

FIG. 9 is a timing chart for explaining operations that occur to cylinder #1 and cylinder #2 in a device of a comparative example. A waveform 90 in a third chart in FIG. 9 shows that a valve of the first oil jet 30 of cylinder #1 opens at the time point t1. Further, a waveform 91 in a fourth chart shows that a valve of the second oil jet 34 of cylinder #1 opens at the time point t2. A waveform 92 in a lowermost chart shows that a valve of the first oil jet 30 of cylinder #2 opens at the time point t3.

In the device of the comparative example, the first oil jet 30 and the second oil jet 34 that are equal in valve opening pressure are included in each of a plurality of cylinders. Valves of these oil jets open at the same valve opening pressure P1, and therefore there is no order concerning which oil jet opens under the environment where the oil pressure of the main gallery 42 is in the vicinity of P1. That is, a valve opening sequence illustrated in FIG. 9 is only one of sequences that are likely to be realized, and there is no reproducibility of the sequence. A variation between cylinders occurs in combinations of the oil jets that are in a valve opening state, until all the valves of the oil jets open after first valve opening occurs. As a result, according to the device of the comparative example, various variations occur to the cooling abilities of the piston 12 in the respective cylinders.

Figure 10:
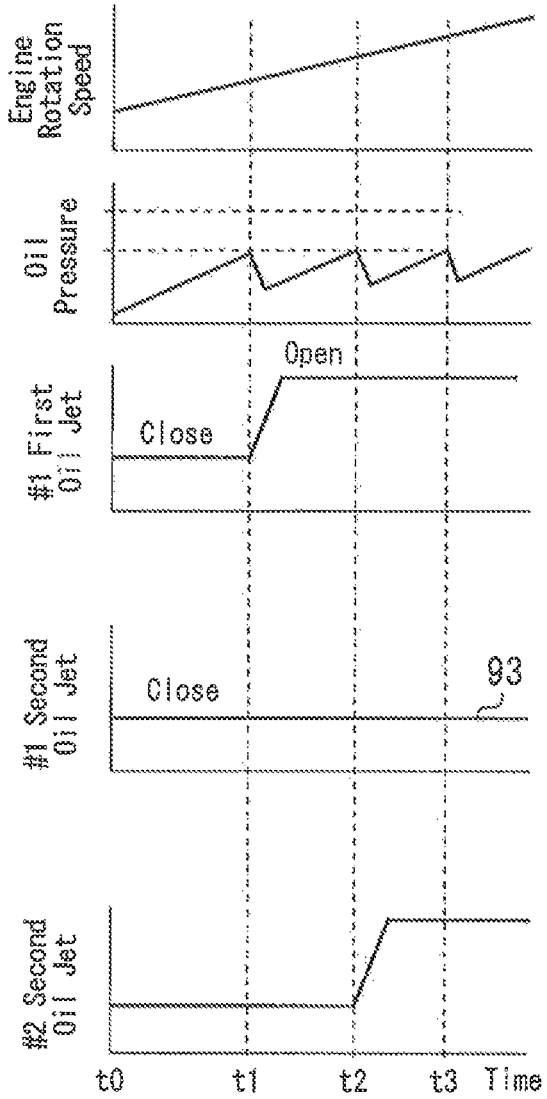
FIG. 10 is a timing chart for explaining operations with which the ununiformity between cylinders are eliminated in the third embodiment of the present invention.

FIG. 10 is a timing chart for explaining operations that occurs to cylinder #1 and cylinder #2 in the device of the present embodiment. A waveform 93 in a fourth chart in FIG. 10 shows that the second oil jet 72 of cylinder #1 stably keeps closed state under a situation where the oil pressure repeatedly reaches the valve opening pressure P1.

In the device of the present embodiment, the valve opening pressure of the second oil jet 72 is set at a value higher than P1 as described above. Under the setting, the valves of the second oil jet 72 does not open in any of the cylinders until the valves of the first oil jets 30 open in all of the cylinders. In this way, in the device of the present embodiment, all of the first oil jets 30 can be brought into valve opening states in preference to all of the second oil jets 72. Consequently, according to the device, the variation in cooling ability in the respective cylinders can be restrained more significantly as compared with the case of the comparative example.

[Modification Example of Third Embodiment]

In the present embodiment, the piston 12 may be made of aluminum as in the case of the first embodiment. Further, the second oil jet 34 may spray oil toward a part other than the piston 12. Further, the number of the second oil jets 34 may be two or more. The oil from the first oil jet 30 may be stopped in accordance with necessity.

Fourth Embodiment

Next, a fourth embodiment of the present invention will be described with reference to FIG. 11 together with FIG. 7. A piston cooling device of the present embodiment can be realized by incorporating three features as follows in a configuration illustrated in FIG. 7.

(1) A two stage type pump is adopted as the oil pump 40. Note that "the two stage type pump" refers to a pump having a function of switching a generated oil pressure selectively to two kinds that are a low pressure side (PL) and a high pressure side (PH).

(2) The valve opening pressure P1 of the first oil jet 30 is set at a value of equal to or lower than the generated oil pressure PL of the low pressure side.

(3) The valve opening pressure P2 of the second oil jet 72 is set at a value that is higher than the generated oil pressure PL of the low pressure side and is equal to or lower than the generated oil pressure PH of the high pressure side.

The two stage type oil pump 40 inevitably generates the oil pressure PL of the low pressure side at the time of the light load operation in which a drive force from the internal combustion engine is insufficient to generate the oil pressure PH of the high pressure side. Further, the oil pump 40 generates the oil pressure PL of the low pressure side under the situation where generation of PH is unnecessary even under the situation where the drive force sufficient to generate the oil pressure PH of the high pressure side can be obtained. According to the configuration of the present embodiment, an amount of useless work can be reduced by properly switching the state of the oil pump 40.

Further, according to the configuration of the present embodiment, only the first oil jet 30 is brought into a valve opening state under the situation where the oil pump 40 generates the oil pressure PL of the low pressure side. Further, when the oil pump 40 generates the oil pressure PH of the high pressure side, both of the first oil jet 30 and the second oil jet 72 are brought into a valve opening state. Consequently, according to the device, a combination of jets that spray oil can be intentionally switched by switching the state of the oil pump 40.

Figure 11:
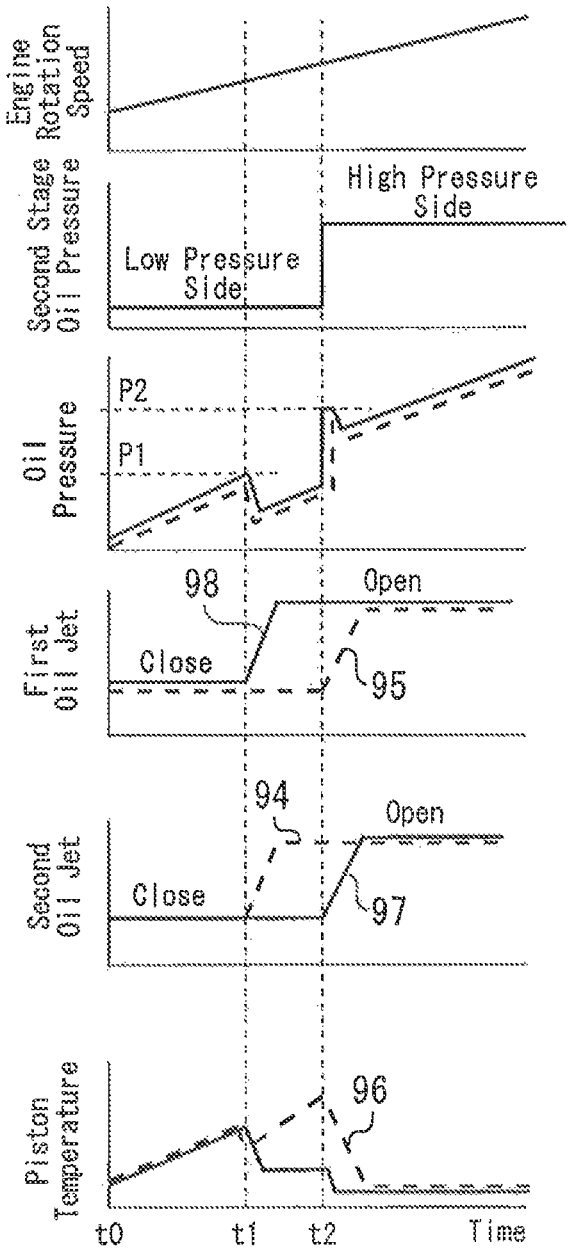
FIG. 11 is a timing chart for explaining an operation performed by a fourth embodiment of the present invention.

FIG. 11 is a timing chart for explaining the operation of the piston cooling device of the present embodiment and an operation of a device of a comparative example in a comparative manner. Here, "the device of the comparative example" refers to a device in which the second oil jet 72 is replaced with the second oil jet 34 in the configuration of the present embodiment.

A second chart in FIG. 11 shows a generated oil pressure of the two stage type oil pump 40. Here, at the time point t2, the generated oil pressure is switched to the value PH of the high pressure side from the value PL of the low pressure side.

In a third chart through a lowermost chart in FIG. 11, waveforms illustrated by broken lines express the operation of the device of the comparative example. On the other hand, waveforms illustrated by solid lines in these charts express the operation of the device of the present embodiment.

The third chart in FIG. 11 illustrates a change of the oil pressure of the main gallery 42. Here, the oil pressure reaches the valve opening pressure P1 at the time point t1. Thereafter, the oil pressure temporary reduces, then reaches the valve opening pressure P2 at the time point t2 with switching of the generated oil pressure.

In the device of the comparative example, the valve opening pressure of the second oil jet 34 is P1 similarly to the valve opening pressure of the first oil jet 30. Consequently, as the waveform 94 in a fifth chart shows, the valve of the second oil jet 34 may open at the time point t1 in the device of the comparative example. In this case, the valve of the first oil jet 30 does not open until the time point t2 as the waveform 95 in a fourth chart shows. As a result, as the waveform 96 in the lowermost chart shows, the temperature of the piston 12 temporarily rises to a high temperature before converging to a stable value.

In the device of the present embodiment, the valve opening pressure of the second oil jet 72 is P2, and therefore, the valve of the second oil jet 72 does not open at the time point t1 (see, the waveform 97 in the fifth chart). As a result, in the device, the valve of the first oil jet 30 reliably opens at the time point t1 (see, the waveform 98 in the fourth chart).

As above, in the device of the present embodiment, only the first oil jet 30 reliably sprays oil while the oil pump 40 generates the oil pressure PL of the low pressure side. When the generated oil pressure is switched to the value PH of the high pressure side, oil also starts to be sprayed from the second oil jet 72 in addition to the first oil jet 30.

Consequently, according to the device of the present embodiment, the piston 12 can be continued to be cooled at a proper temperature stably for a long period of time without generating deposit in the cooling cavity 26, as in the case of the third embodiment. Further, according to the device of the present embodiment, the combination of the jets that spray oil can be accurately switched by switching the state of the oil pump 40. Thus, according to the device, the cooling ability to the piston 12 can be controlled more intentionally as compared with the case of the third embodiment.

[Commonness with Third Embodiment]

The device of the present embodiment is similar to the device in the third embodiment in the point that variations in the cooling abilities in a plurality of cylinders can be suppressed. Further, the modification examples explained about the third embodiment are also applicable to the device of the present embodiment.

What is claimed is:

1. A piston cooling device that is installed in an internal combustion engine, the piston cooling device comprising:

a cooling cavity that is provided inside a piston, and includes an inlet/outlet hole that opens on a bottom surface of the piston;

a first oil jet that sprays oil toward the inlet/outlet hole;

a second oil jet that sprays oil toward a part different from the inlet/outlet hole;

a valve or a pump that supplies the oil that is sprayed from the second oil jet; and an electronic control unit configured to control the valve or the pump such that the first oil jet sprays oil in preference to the second oil jet, wherein the first oil jet sprays oil to the inlet/outlet hole and thereafter the second oil jet sprays oil to the part different from the inlet/outlet hole.

2. The piston cooling device according to claim 1, further comprising:

an oil pump that generates an oil pressure that is necessary to spray oil;

wherein when a discharge oil amount of the oil pump is smaller as compared with an oil amount necessary to cause oil to be sprayed from both of the first oil jet and the second oil jet, the discharge oil amount is consumed preferentially in oil spray from the first oil jet.

3. The piston cooling device according to claim 2, wherein the first oil jet and the second oil jet communicate with the oil pump via a common oil pressure path, and a valve opening pressure of the first oil jet is a lower pressure as compared with a valve opening pressure of the second oil jet.

4. The piston cooling device according to claim 3, wherein the oil pump is a two stage type oil pump having a function of switching a generated oil pressure to two stages of a low pressure side generated oil pressure and a high pressure side generated oil pressure, the valve opening pressure of the first oil jet is equal to or lower than the low pressure side generated oil pressure, and the valve opening pressure of the second oil jet is higher than the low pressure side generated oil pressure, and is equal to or lower than the high pressure side generated oil pressure.

5. The piston cooling device according to claim 3, wherein the internal combustion engine comprises a plurality of cylinders, the first oil jet and the second oil jet are disposed in each of the cylinders, and the first oil jet and the second oil jet that belong to each of the plurality of cylinders communicate with the common oil pressure path.

6. The piston cooling device according to claim 4,
wherein the internal combustion engine comprises a plurality of cylinders,
the first oil jet and the second oil jet are disposed in each of the cylinders, and
the first oil jet and the second oil jet that belong to each of the plurality of cylinders communicate with the common oil pressure path.

7. The piston cooling device according to claim 2,
wherein the first oil jet and the second oil jet communicate with the oil pump via a common oil pressure path, and
the electronic control unit is configured to control the valve or the pump such that the amount of the oil that is sprayed from the second oil jet decreases, when an oil pressure that is supplied to the first oil jet is lower as compared with a pressure that is necessary to cause oil to be sprayed from the first oil jet.

8. The piston cooling device according to claim 2, comprising:
an oil pump that supplies an oil pressure to the first oil jet by being driven by drive torque of the internal combustion engine, wherein
the valve or the pump comprises an electric oil pump that is driven by electric power and supplies an oil pressure to the second oil jet, and
the electronic control unit is configured to cause oil that is supplied from the electric oil pump to be sprayed from the second oil jet under a condition in which oil spray by the second oil jet is required.

9. The piston cooling device according to claim 1,
wherein an amount of oil that is sprayed from the second oil jet is preferentially decreased under a condition of excessive cooling ability in which excessive cooling occurs to the piston when oil is sprayed from both of the first oil jet and the second oil jet.

10. The piston cooling device according to claim 9, wherein the electronic control unit is configured to control the valve or the pump such that the amount of the oil that is sprayed from the second oil jet decreases under the condition of excessive cooling ability.

11. The piston cooling device according to claim 1, wherein the piston is made of steel.

12. A piston cooling device that is installed in an internal combustion engine, the piston cooling device comprising:
a cooling cavity that is provided inside a piston, and includes an inlet/outlet hole that opens on a bottom surface of the piston;
a first oil jet that sprays oil toward the inlet/outlet hole; and
a second oil jet that sprays oil toward a part different from the inlet/outlet hole, wherein
the first oil jet comprises a first check valve configured to open at a first valve opening pressure, and
the second oil jet comprises a second check valve configured to open at a second valve opening pressure that is higher than the first valve opening pressure such that the first oil jet sprays oil in preference to the second oil jet, wherein the first oil jet sprays oil to the inlet/outlet hole and thereafter the second oil jet sprays oil to the part different from the inlet/outlet hole.

13. The piston cooling device according to claim 12, further comprising:
an oil pump that generates an oil pressure that is necessary to spray oil;
wherein when a discharge oil amount of the oil pump is smaller as compared with an oil amount necessary to cause oil to be sprayed from both of the first oil jet and the second oil jet, the discharge oil amount is consumed preferentially in oil spray from the first oil jet.

14. The piston cooling device according to claim 13,
wherein the first oil jet and the second oil jet communicate with the oil pump via a common oil pressure path.

15. The piston cooling device according to claim 14,
wherein the oil pump is a two stage type oil pump having a function of switching a generated oil pressure to two stages of a low pressure side generated oil pressure and a high pressure side generated oil pressure,
the first valve opening pressure is equal to or lower than the low pressure side generated oil pressure,
and the second valve opening pressure is higher than the low pressure side generated oil pressure, and is equal to or lower than the high pressure side generated oil pressure.

16. The piston cooling device according to claim 14,
wherein the internal combustion engine comprises a plurality of cylinders,
the first oil jet and the second oil jet are disposed in each of the cylinders, and
the first oil jet and the second oil jet that belong to each of the plurality of cylinders communicate with the common oil pressure path.

17. The piston cooling device according to claim 15,
wherein the internal combustion engine comprises a plurality of cylinders,
the first oil jet and the second oil jet are disposed in each of the cylinders, and
the first oil jet and the second oil jet that belong to each of the plurality of cylinders communicate with the common oil pressure path.

18. The piston cooling device according to claim 12, wherein the piston is made of steel.

* * * * *